US010532262B2

(12) United States Patent
Carney

(10) Patent No.: US 10,532,262 B2
(45) Date of Patent: Jan. 14, 2020

(54) TELESCOPING FOOTBALL HOLDER

(71) Applicant: John M. Carney, Encinitas, CA (US)

(72) Inventor: John M. Carney, Encinitas, CA (US)

(73) Assignee: JMC VENTURES, L.L.C. OF DELAWARE, Carlsbad, CA (US)

( * ) Notice: Subject to any disclaimer, the term of this patent is extended or adjusted under 35 U.S.C. 154(b) by 0 days.

(21) Appl. No.: 16/501,424

(22) Filed: Apr. 12, 2019

(65) Prior Publication Data

US 2019/0262688 A1 Aug. 29, 2019

Related U.S. Application Data

(63) Continuation-in-part of application No. 15/732,219, filed on Oct. 6, 2017, now abandoned.

(60) Provisional application No. 62/496,492, filed on Oct. 20, 2016.

(51) Int. Cl.
*A63B 71/00* (2006.01)
*A63B 69/00* (2006.01)

(52) U.S. Cl.
CPC ..... *A63B 69/0075* (2013.01); *A63B 69/002* (2013.01); *A63B 2210/50* (2013.01); *A63B 2225/09* (2013.01); *A63B 2243/007* (2013.01)

(58) Field of Classification Search
CPC ..... A63B 69/0075; A63B 2210/50; A63B 2243/007; A63B 69/00; A63B 69/0073
USPC ..... 473/419, 420, 422, 438; D21/716–719, D21/788
See application file for complete search history.

(56) References Cited

U.S. PATENT DOCUMENTS 3,439,916 A * 4/1969 Kopp ..... A63B 69/0075 473/419
3,462,145 A * 8/1969 Shirley ..... A63B 69/0075 473/419
3,472,511 A * 10/1969 Shirley ..... A63B 69/002 473/419
D235,462 S * 6/1975 Pennington ..... D21/716
3,897,948 A * 8/1975 Gerela ..... A63B 69/0073 473/419
3,917,278 A * 11/1975 Steinman, Jr. ..... A63B 24/0003 473/267
4,546,974 A * 10/1985 Brown ..... A63B 69/0075 473/419
4,632,395 A * 12/1986 Ferrebee ..... A63B 69/0075 473/419
4,634,122 A * 1/1987 Kline ..... A63B 69/0075 473/419
4,946,165 A * 8/1990 Rambacher ..... A63B 69/0075 473/419
D338,250 S * 8/1993 Tvedt ..... D21/716
5,490,668 A * 2/1996 Ritch ..... A63B 69/0075 473/419
5,505,445 A * 4/1996 Treadwell ..... A63B 69/0075 473/419

(Continued)

OTHER PUBLICATIONS

"Coil Springs vs Belleville Springs", Belleville International, pp. 1-3, Internet Document, May 28, 2013 (See p. 1, first two sentences of first paragraph.).

*Primary Examiner* — Mitra Aryanpour

(57) ABSTRACT

A compact device for assisting place kicking a football is disclosed, including a module connecting telescoping legs and football tip telescoping holding arm, with the legs connecting the module for pivoting the legs from a ground engaging position to a transport position beneath and parallel to the arm.

20 Claims, 13 Drawing Sheets

(56) References Cited

U.S. PATENT DOCUMENTS

| | | | | |
|---|---|---|---|---|
| D419,212 | S * | 1/2000 | Cooper | D21/716 |
| 6,719,650 | B1 * | 4/2004 | Thurlow | A63B 69/0075 473/420 |
| 7,874,438 | B2 | 1/2011 | Despres | |
| 8,342,987 | B2 * | 1/2013 | Shaw | A63B 69/0075 473/419 |
| 9,371,958 | B2 | 6/2016 | Johnson | |
| 2018/0111031 | A1 * | 4/2018 | Carney | A63B 69/0075 473/419 |

* cited by examiner

TELESCOPING FOOTBALL HOLDER

CROSS-REFERENCE TO RELATED APPLICATION/INCORPORATED BY REFERENCE

This application is a continuation in part patent application and makes reference to, and claims the benefit of priority under 35 U.S.C. 120 from co-pending non-provisional U.S. application Ser. No. 15/732,219, filed Oct. 6, 2017, entitled "Telescoping Football Holder", which claims the benefit of priority under 35 U.S.C. 119(e) from provisional application U.S. Ser. No. 62/496,492, filed Oct. 20, 2016, entitled "Telescoping Football Holder", now expired, both of these applications having a common applicant therewith and are herein incorporated by reference in their entirety.

FIELD OF THE INVENTION

The present invention relates to football holding devices. More particularly, the present invention is directed to devices for assisting in training football kickers of American/Canadian style footballs. Still more particularly, the present invention relates to easily compactable and simple telescoping ground engaging legs connected by a module at their proximate ends by pivot posts mounted on an inverted v-shaped module which also rigidly mounts a telescoping arm for engaging the tip of the football which simulates a person holding the football.

BACKGROUND OF THE INVENTION

In preparation for playing the game of football, place kickers spend many hours in practicing for accuracy as to distance and ball placement, as for example practicing to either kick the ball into/through the end zone or to force a kick returner to field the ball before the ball enters the end zone. In practice it has been the practice to utilize a second person to hold the football for place kicking to simulate game conditions. Many devices have been invented to replace the second person by which the place kicker can practice without the place holder person.

These devices include, for example, the device shown in U.S. Pat. No. 5,505,445 to Treadwell et al. This device includes two ground engaging legs mounted in a pivotal manner to extend outwardly from a center module which center module also mounts a third leg which is pivotal on the center module and extends horizontally to hold the tip of the football in kicking position. The three legs are mounted to be pivotal so as to be collapsible for ease of transport and storage. This device lacks any telescoping features of the legs.

Another football holding device is disclosed in U.S. Pat. No. 8,342,987 to Shaw et al. This device has two ground engaging legs and a horizontally extending third leg all connected to a center module. The legs are formed of multiple tubes with each leg being disclosed as "hollow tubes that nest with its adjacent section by way of a telescopic, nesting interface arrangement." An inverted v-shaped module has guide holes for receiving the proximate ends of the three legs. A bungee cord extending through the hollow tubes and the module is used to secure the three legs in place relative to the holes of the connecting module. The place kicker pulls the ends of the three legs away and out of the mounting holes against the retaining spring force of the bungee cord to thereby de-nest and fold the device in a compact disassembled form. No telescopic adjustment of the lengths of the legs along the axis of the lengths of the three legs is taught. This lack of a telescopic adjustment feature limits the device to the type and size of the football used for a particular level of competition as the patent does state "the device could also be downsized, in the event it were to be used for juvenile-sized football."

U.S. Pat. No. 5,553,855 to Balestrieri discloses a vertical telescopic support wherein the vertical hollow tubing 27 and 29 are slide relative to each other and the length locked and controlled by a knob turned to press against a flexible collar trapped between the inner wall of tube 27 and the outer wall of smaller tube 29 as best viewed in FIG. 3. Three legs 13a, 13b and 13c are used to support the vertical hollow tubing and can be pivoted to align with the vertical axis of the vertical hollow tubing but are not telescopic. Further, an arm 49 used to support the tip of the football is not telescopic. This device is compactable as both arm 49 and the three support legs are pivotal relative to the vertical hollow tubing. U.S. Pat. No. 4,546,974 to Brown discloses vertically telescoping hollow square tubes with a locking detent extending through a vertical slot in an outer tube wall as part of a height adjustable place kick holder.

OBJECTS AND SUMMARY OF THE INVENTION

It is an object of the present invention to provide a football place kicker holder which takes the place of a player holder during practice of the place kicker.

It is another object of the present invention to provide the place kicker holder the ability to be adjustable as to the angle at which the football is tilted so as to better accommodate the kicker's style such as a side kicking soccer style leg swing as contrasted with a straight on leg swing.

It is another object of the present invention to have the place kicker holder compact for storage and transportation.

It is another object of the present invention to have the place kicker holder easily adjustable to accommodate different sizes of footballs.

It is yet another object of the present invention to provide an inexpensive but durable to manufacture place kick holder.

It is yet another object of the present invention to provide a place kick holder which is easy to set up quickly and operate and adjust.

These and other objects of the present invention will become apparent from the following detailed description.

DETAILED DESCRIPTION OF THE INVENTION

Figure 1:
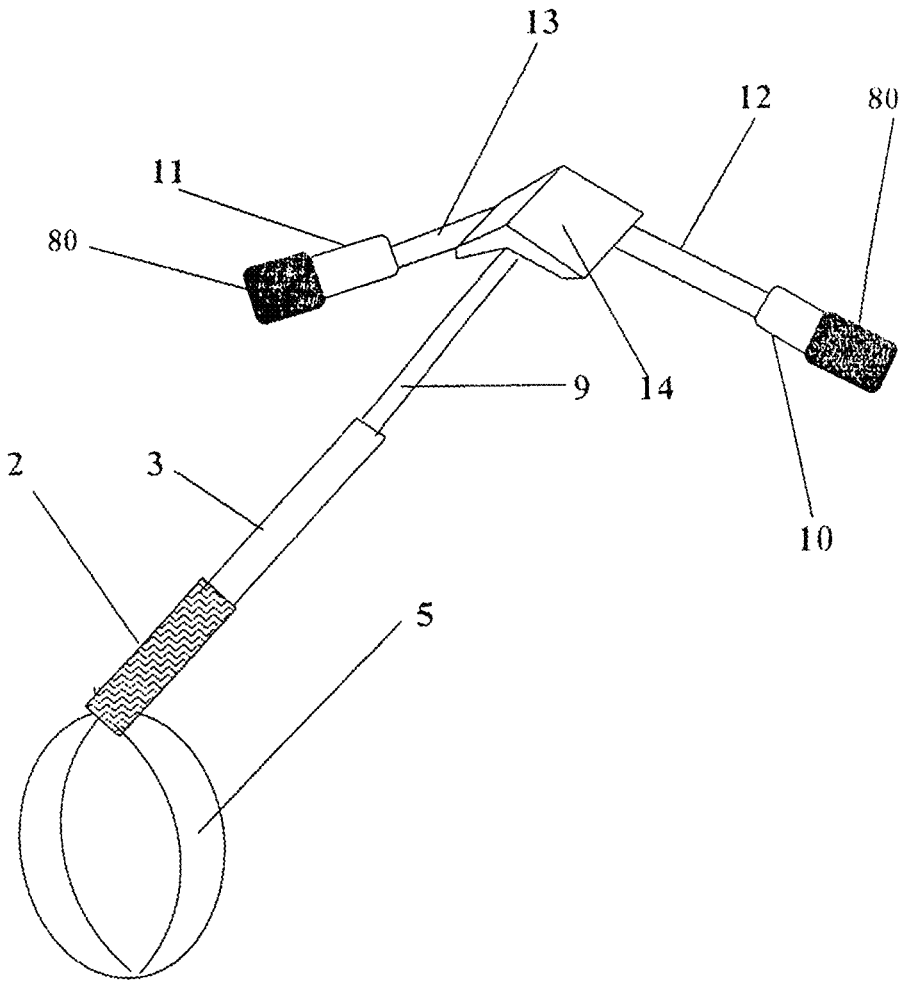
FIG. 1 is a perspective view of a football place kicker holder in accordance with the present invention, supporting a football for kicking in a tripod form.

As shown in FIG. 1, a football 5 is supported by a telescopic arm comprising an outer hollow tube 2 which telescopes over a smaller diameter hollow tube 3 and an optional third yet smaller diameter hollow tube 9 over which both tubes 2 and 3 telescope. In the preferred embodiments only tubes 2 and 3 are deployed. The outer surface of tube 2 may be knurled or covered with a soft memory recoverable deformable material which permits the tip of the football to slightly depress the soft material so as to better engage the tube 2 to simulate the touch of a human holder. The soft material is memory recoverable and spring-like and returns to its normal state after being removed from contact with the football tip. Also, the surface of the soft material facilitates the grip the kicker has for ease of adjusting the sliding action of the telescoping tube 2, especially useful on a rainy/snowy outdoor practice day.

Figure 3:
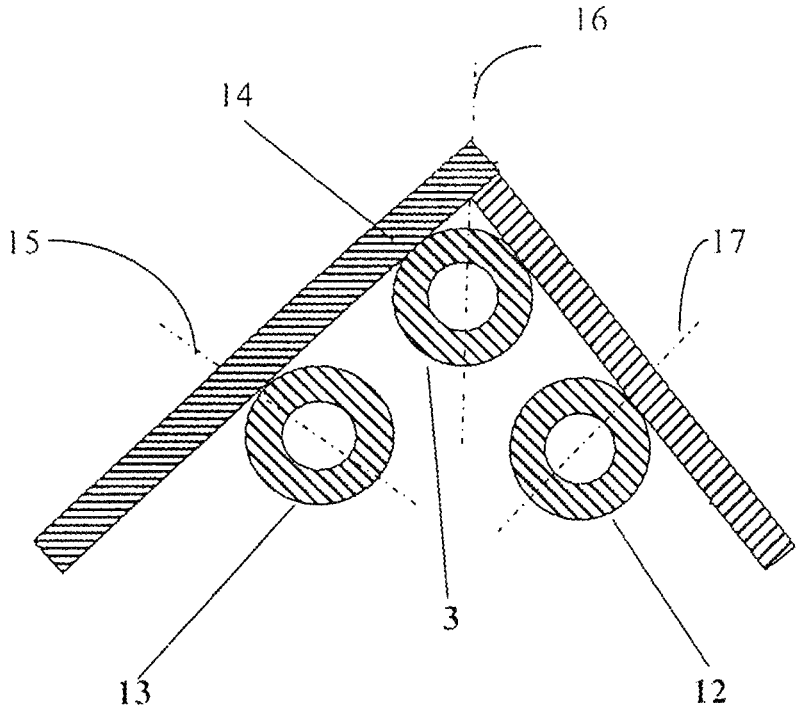
FIG. 3 is a cross section taken along section X-X of FIG. 2.

In this description, the terms "tube" and "tubular" are used in their broadest generic sense to encompass the preferred cross sectional round tubes shown in FIG. 3 and non-round forms, such as by way of non-limiting example, triangular or square telescoping tubes (not shown).

Figure 6:
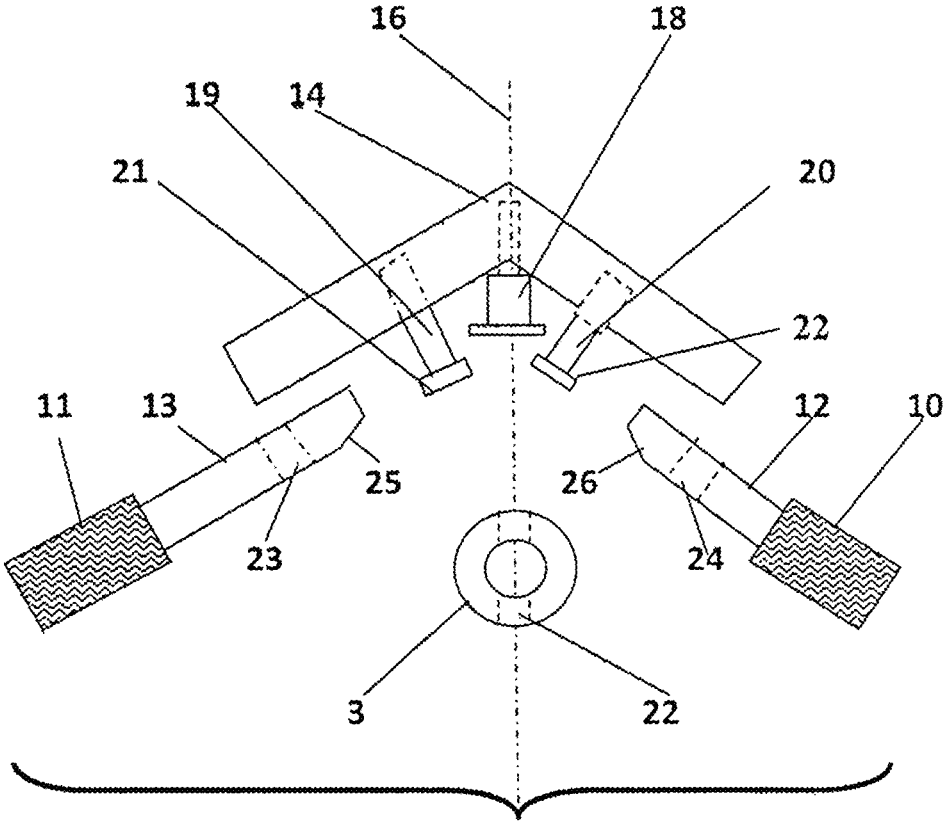
FIG. 6 is an exploded view showing details of the mounting of the telescopic legs and football holder arm of the place kicker holder of FIG. 1.

Also disclosed in FIG. 1 are two telescopic ground engaging hollow leg pairs 10,12 and 11,13 preferably tubular in form. The outer surface of the legs 10 and 11 maybe covered with enclosed end caps 80 to prevent entry of foreign objects and to ensure a better grip by the place kicker in adjusting the telescopic sliding action of tubes 10 and 11. An inverted v-shaped module 14 connects the innermost proximal ends of tubes 3, 12 and 13 as shown in FIG. 6.

Figure 2:
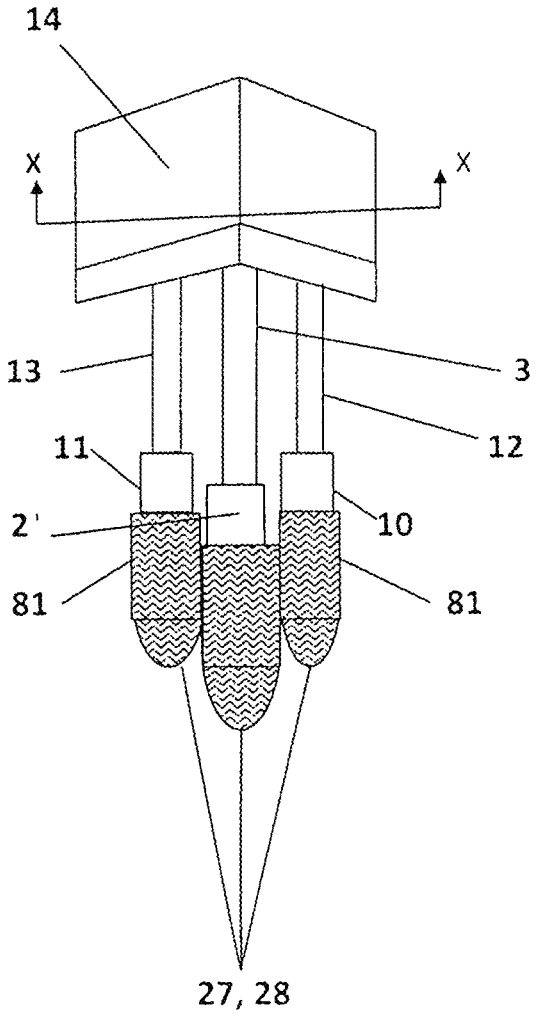
FIG. 2 is the place kicker holder of FIG. 1, shown in a plan view, nested or collapsed form for stowage.

While FIG. 1 depicts the football place kicker holder in operative deployment, FIG. 2 shows the compact nested form in a stowage position. The kicker has telescopically collapsed the football holder tube 2 partially over the smaller diameter tube 3. Also, the two leg pairs 10, 12 and 11, 13 are telescopically partially collapsed. Additionally, the kicker has pivoted the tubular leg pairs 10, 12 and 11, 13 about pivot rivets or shafts 19 and 20 (shown in FIGS. 6 and 9) attached to the underside of the inverted v-shaped module 14.

A smooth adjustment of the desired lengths of the telescopic arm and the telescopic legs is achieved by providing tight clearance tolerances between the inner surface of the outer diameter tube and the outer surface of the smaller diameter tube. The tight tolerances permit use of air drag as a resistance to hold the position of the tubes. The tubes are easily moved to different relative positions against the pressure of air drag between the surfaces. A more secure twist-lock in the desired position can be achieved by twisting the tubes as is commonly done, for example with telescoping boat hooks. A metal of light weight, such as anodized aluminum or steel, is the preferred material for the tubes but plastics such as polypropylene, fiberglass or nylon may also be used.

Figure 7:
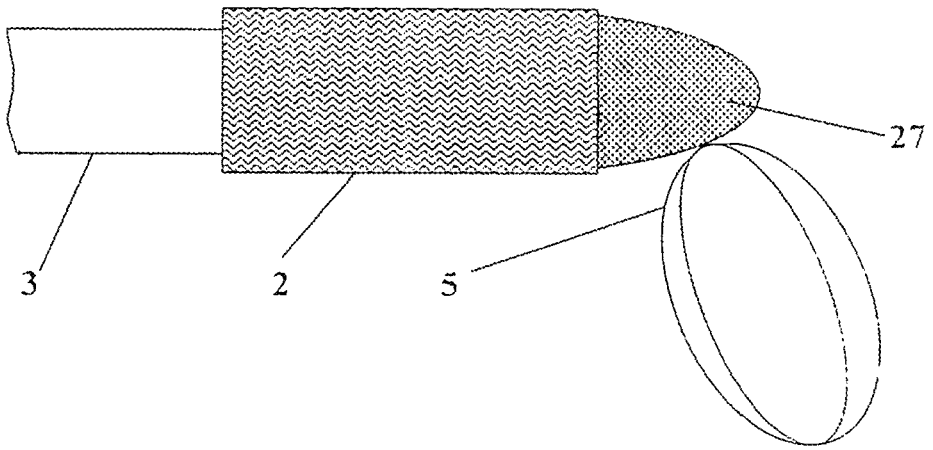
FIGS. 7 and 8 depict alternate add on elliptical and spherical friction tips to the place kick holder arm end of FIG. 1.
Figure 8:
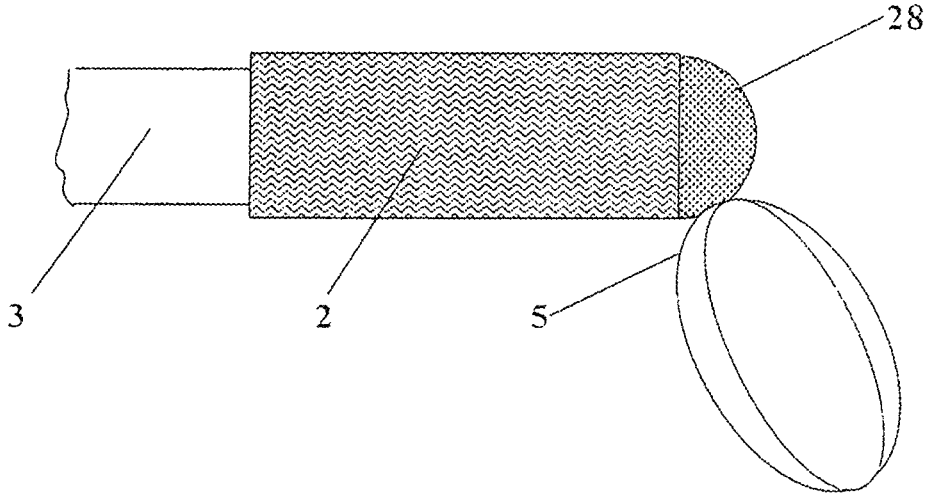

Both tubes 12 and 13 swing underneath the horizontally extending hollow tube 3 as shown in FIG. 2. The end caps 80 shown in FIG. 1 may optionally be replaced by modified end caps 81 having elliptical tips 27. Spherical tips 28 can also be used. Tips 27 and 28 are discussed in detail in connection with FIGS. 7 and 8. Also tip 27 or 28 maybe mounted at the end of telescopic holder arm 2. This arrangement allows the kicker the option to switch between spare tips 27 and 28 on legs 10 and 11 and the tip mounted at the end of telescopic holder arm 2.

FIG. 3 is a cross sectional view taken along the X-X plane as shown in FIG. 2 showing the stowage positioning for the tubes 12 and 13 before they are telescopically collapsed. Tube 3 is fixed against movement by two fastening rivets or screws 18 only one of which is shown in FIG. 6 attached to the peak of the underside of the module 14. The inner end of tube 12 has a pivot hole 24 for securing the tube 12 to pivot about a fixed rivet or shaft 20 mounted on the underside of the module 14. Likewise, the inner end of tube 13 has a pivot hole 23 for securing the tube 13 to pivot about rivet or shaft 19 fixed to the underside of the module 14. Shafts 19 and 20 have heads 21, 22 to retain the arms 12, 13.

Figure 9:
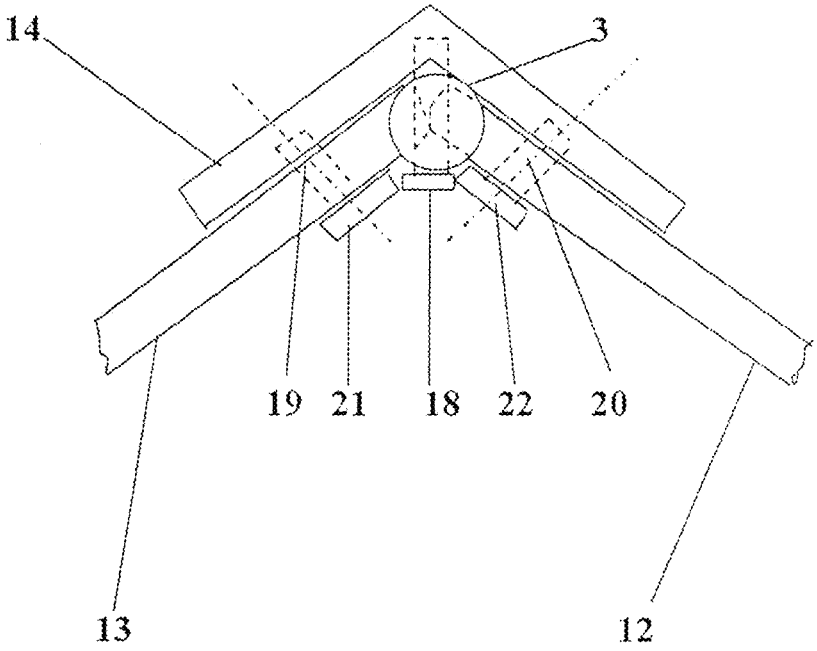
FIG. 9 is a front view of the place kick holder of FIG. 1.

Referring to FIGS. 6 and 9, the inner ends of tubes 12 and 13 have angled planar surfaces 25 and 26 which abut each other when the tubes 12 and 13 are in the football holding tripod position shown in FIG. 1. The inner end of tube 3 is located under module 14 in front of the inner ends of tubes 12 and 13 and abuts the inner ends of tubes 12 and 13 thereby limiting rotation of the leg pairs 10, 12 and 11, 13 to the position shown in FIG. 1.

Figure 4:
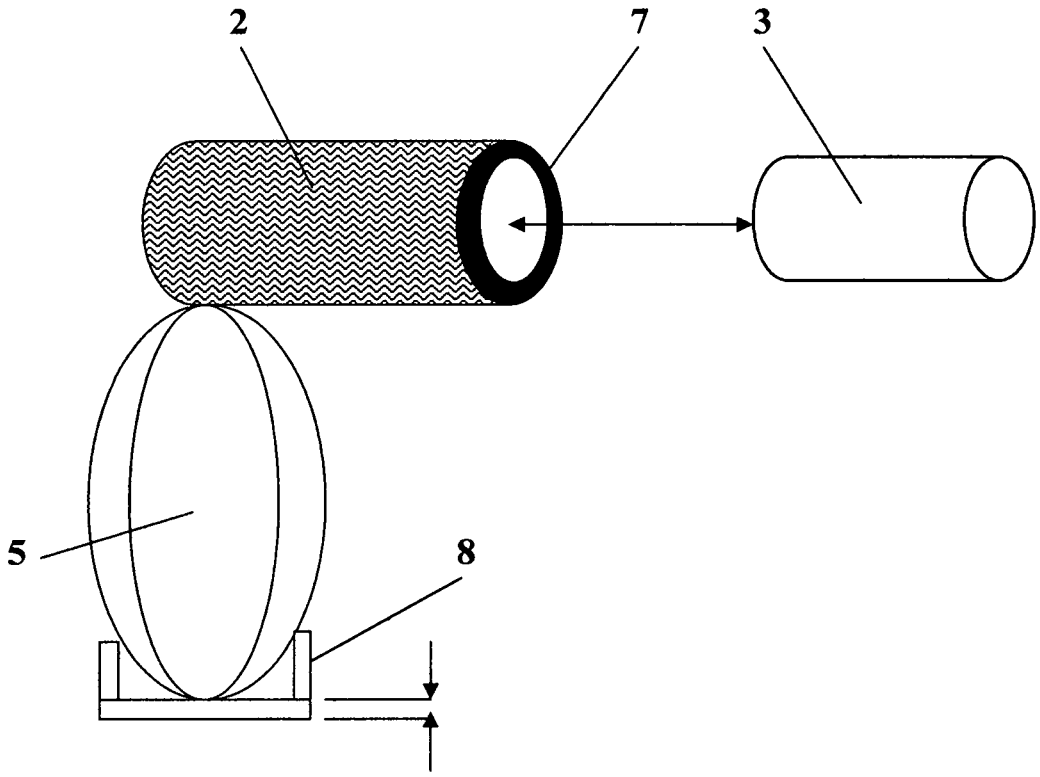
FIG. 4 is a side elevation view of the place kicker holder of FIG. 1, showing the football engaging arm with a variable telescoping length with the football vertically mounted on a kicking tee.

FIG. 4 is an example of using a kicking tee 8 with the present invention. Opening 7 permits the telescoping of outer diameter tube 3 relative to the inner tube 2 as shown by the double arrow in FIG. 4.

Figure 5:
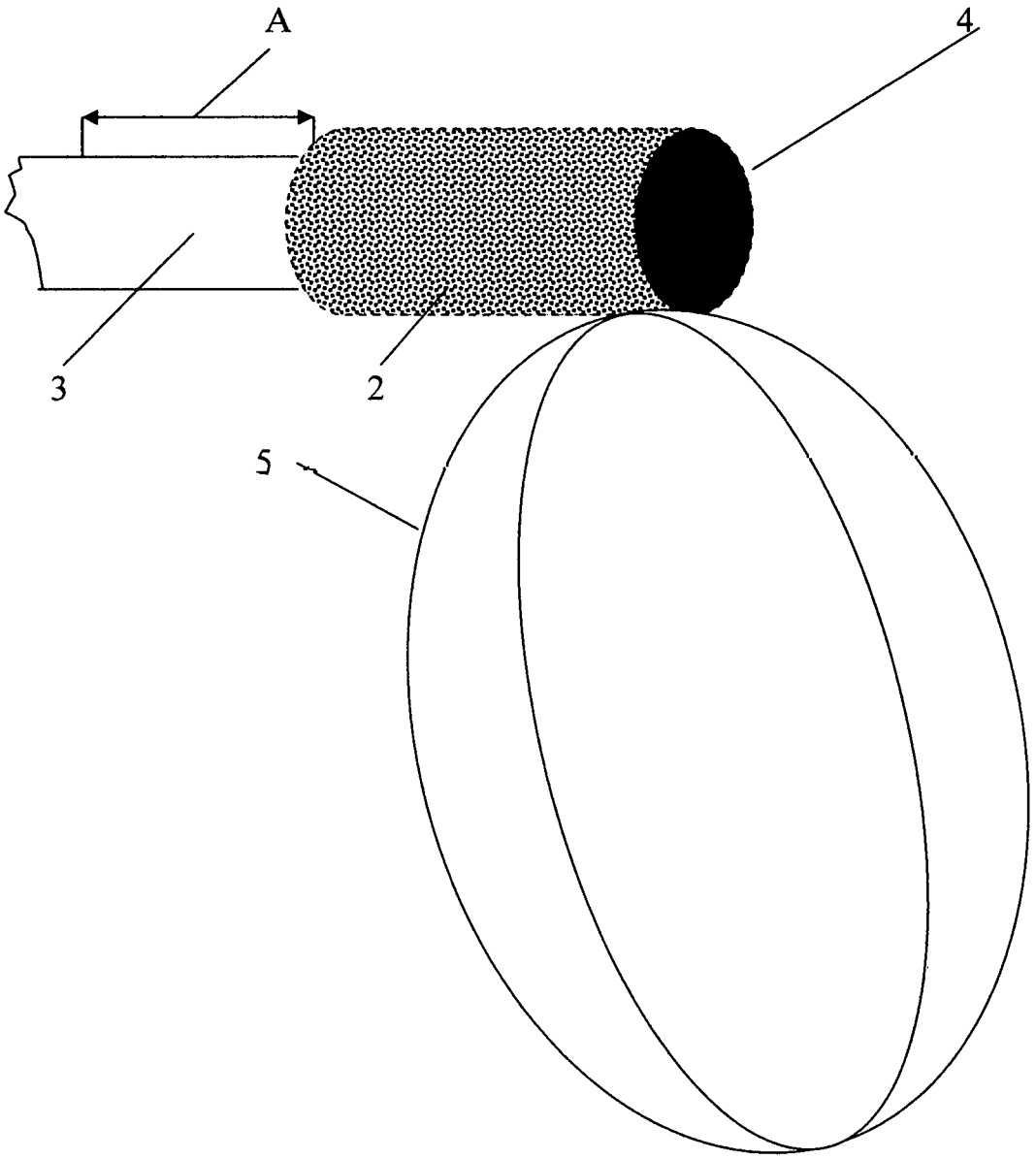
FIG. 5 is a side elevation view of the place kicker holder with the football engaging arm's surface having a pattern holding the football tip at an angle.

FIG. 5 illustrates the maximum telescoping extension (double arrow A) of the tube 2 with a different pattern for the exterior surface pattern of tube 2 than that shown in FIG. 1 which showed a wavy pattern. Other forms of patterns (not shown) are also within the purview of the present invention. In this way the place hold kicker has a choice between patterns depending on a variety of factors such as wind and rain/snow conditions at the practice field.

The patterns in tubular form may be slipped on/off over an existing pattern to economize on the number of telescoping football holders needed for practice.

Some place holder kickers prefer the football's longest axis to be held at a more extreme angle from the vertical due to the player's leg kicking style. An add-on, such as an elliptical end 27 shown in FIG. 7 or a semi-spherical end 28 shown in FIG. 8, may be fastened or adhered to the end of the tube 2 to provide for such extreme angle football tip placement. The surfaces of ends 27 and 28 may also have other patterns, such as a knurled pattern or a deformable material pattern which may or may not be similar to the surface pattern of tube 2 shown in the previously discussed FIG. 1 invention. U.S. Pat. No. 5,464,209 to Sang teaches gum as a known deformable material used to hold a football tip.

Figure 10:
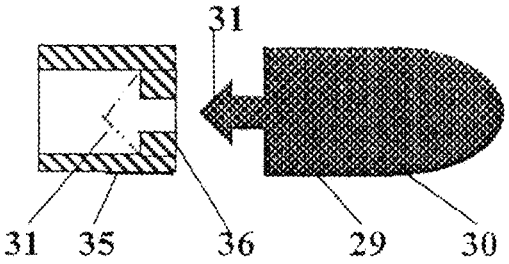
FIG. 10 is a side view of an add-on elliptically contoured tip showing mounting engagement with an end cap for securing to the end of the football holder arm of the FIG. 1 embodiment.

A variation of the add-on shape is shown in FIG. 10 wherein the elliptical tip 30 is part of a removable flexible rubber plug 29 inserted in an end cap 35 shown in section with an open end 36. The prong shaped end 31 of the plug 29 is retained behind the end cap open end 36 as shown by phantom prong shaped end 31. The end cap 35 may be fastened or placed over the end of tube 2 in a secure manner.

Figure 11:
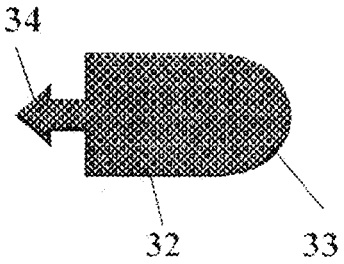
FIG. 11 is a side view of a contour tip variation in spherical form of that shown in FIG. 10.

In like fashion, the add-on of FIG. 11 has a semi-spherical tip 33 as part of a removable flexible rubber plug 32 having a prong shaped end 34 to engage the end cap shown in FIG. 10. The teaching of a prong shaped end is only meant as an example and other forms of flexible retaining ends are also within the purview of the present invention.

The compact holder in the deployed form depicted in FIG. 1 resembles a tripod and in a collapsed compact telescopic stowage form the legs and football holding arm are in the same horizontal direction shown in FIG. 2. The present invention solves many of the prior art place kick holder drawbacks by providing a compactable, durable, simple to deploy, inexpensive, and add-on modifiable configuration thereby allowing the place kicker to customize the compactable holder to the kicker's preference as to kicking style.

Although not shown, it is to be understood that internal conventional devices are used to limit the maximum extent of the telescoping action of the tubes described above so as to prevent tube separation. Also employed to prevent separation are several annular grooves (not shown) in the tube 2 outer surface near the inner end of the tube 2.

Close tolerance to avoid unwanted slippage is essentially between the inner cylindrical surface of tube 2 and the outer cylindrical surface of the smaller diameter tube 3 to maintain an air sleeve between the cylindrical surfaces allowing precise telescopic positioning relative tubes 2 and 3.

Figure 12:
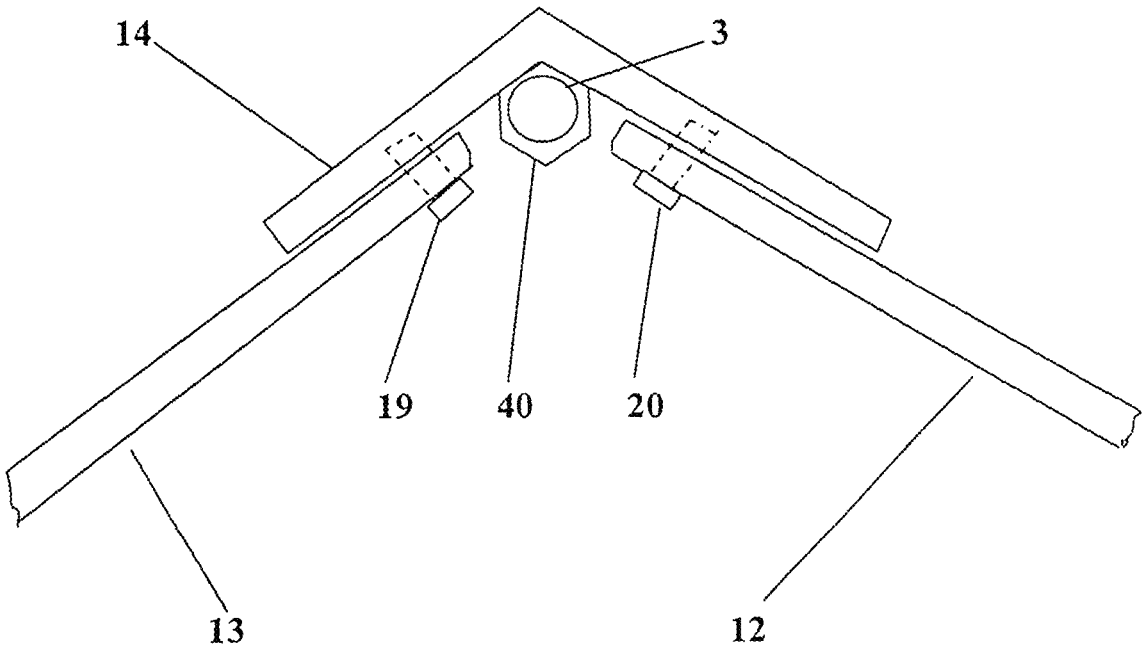
FIG. 12 is a front view of a different embodiment of module 14 mounting a hexagonal fastening nut for receiving an end portion of the football holder arm 3.

In a variation shown in FIG. 12, an elongated hexagonal holding nut 3 is secured to the underside of the inverted v-shaped module 14 as a means of securing the proximal end of the football tip holder arm 3.

Figure 13:
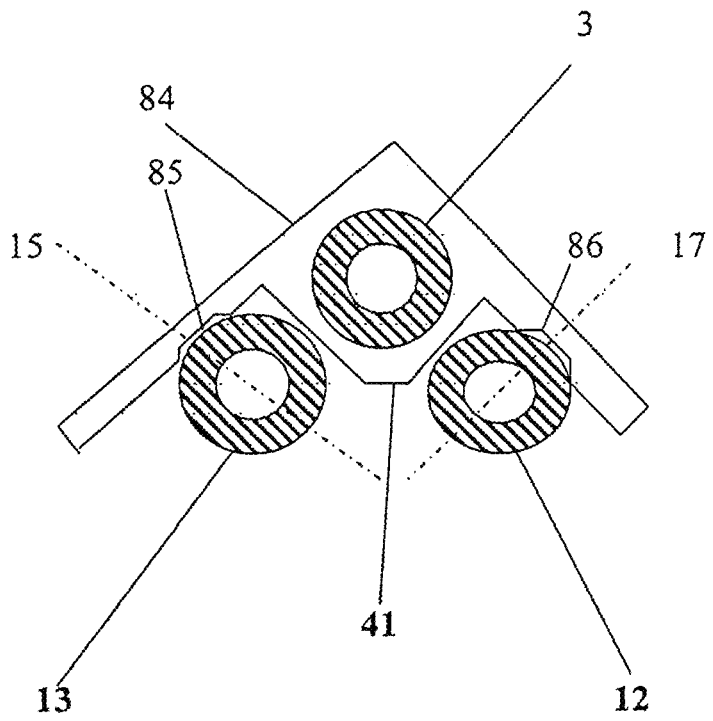
FIG. 13 is a front view of another embodiment of module 84 having a diamond shaped holder 41 for the football holder arm and showing leg positioning grooves cut in the underside of the module 84.
Figure 14:
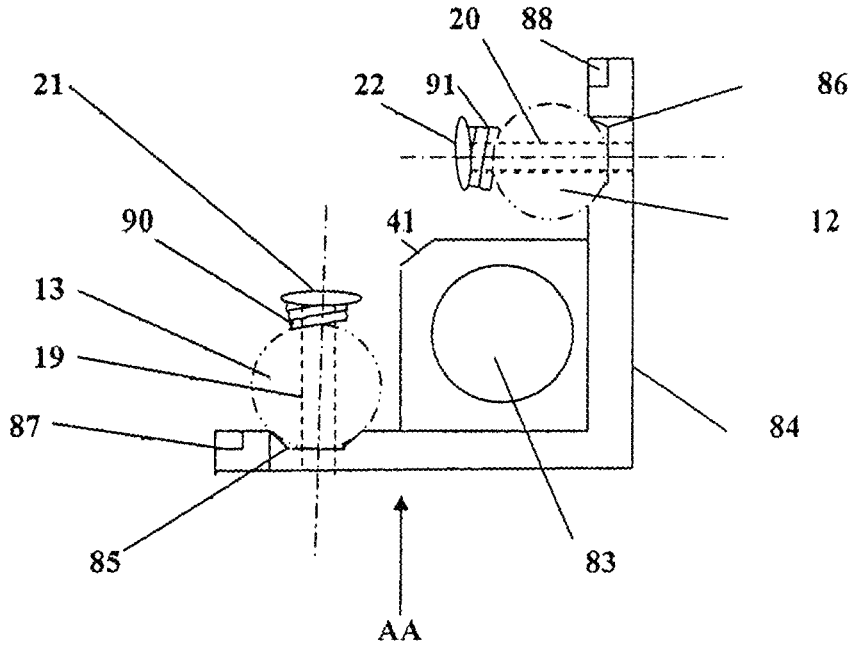
FIG. 14 is a rear view of the module 84 of FIG. 13 lying on one side.
Figure 15:
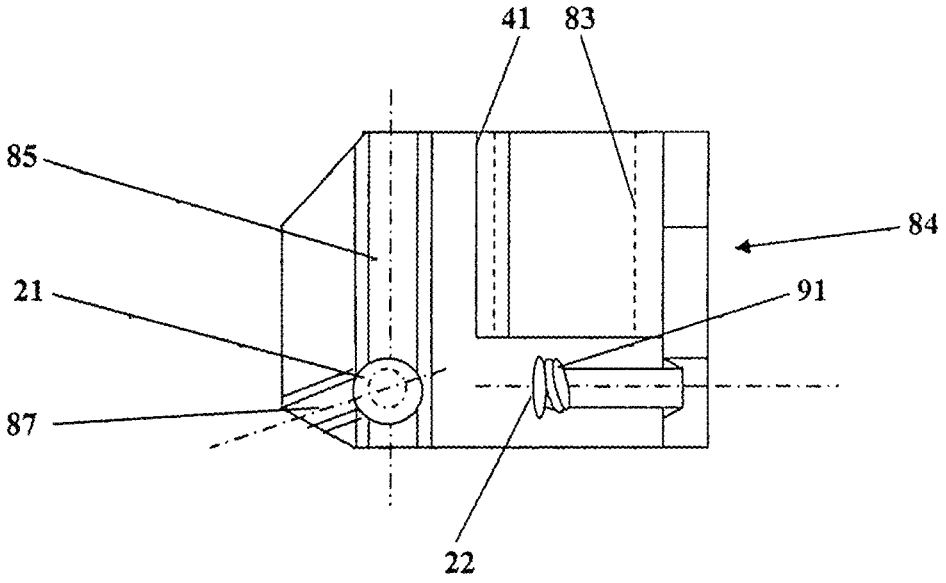
FIG. 15 is a top view of the module 84 of FIG. 14 lying on one side showing in detail the positions of the leg positioning grooves of FIG. 14.

In a preferred variation shown in FIGS. 13-16, a diamond shaped holder 41 is made integral as a portion of a modified inverted v-shaped module 84. FIG. 13 is a frontal view wherein ground engaging legs 12, 13 are shown in cross section as is the football tip holder arm 3 shown secured in a bore hole 83 (FIGS. 14 and 15) in the diamond shaped holder 41. FIG. 14 is a rear view illustrating the inverted v-shaped module 84 lying on one side of the module. FIG. 15 is a top view of FIG. 14. The bore hole 83 extends along the length of the diamond shaped holder 41 but does not extend all the way along the length of the sides constituting the inverted v-shaped module 84.

To secure the legs 12, 13 in the stowage position parallel to the football tip holder arm 3 shallow grooves 85, 86 are located on the inner sides of the module 84. Similar shorter shallow grooves 87, 88 are made in the inner sides of the module 84 which secure the legs 12, 13 when pivoted around the rivets or shafts 19, 20 to the ground engaging position. Compression springs 90, 91 (best shown in FIG. 14) are placed between the underside of the heads 21, 22 and the bore hole extending through the legs 12, 13 to firmly pressure the legs 12, 13 in the selected groove.

Figure 16:
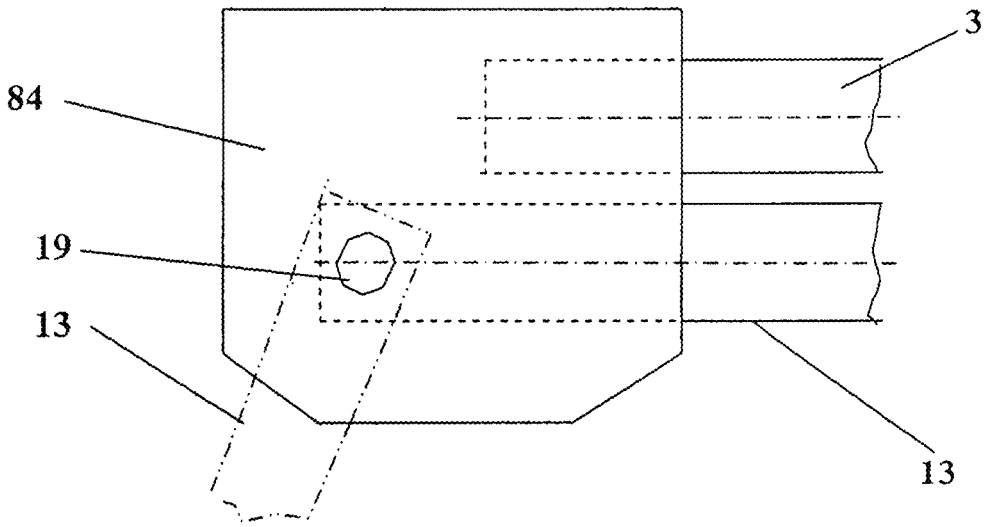
FIG. 16 is a top view along the arrow AA of one side of the module 84 depicted in FIG. 14 showing in phantom outline the positions of one of the two telescopic legs.

FIG. 16 shown viewed from the direction of arrow AA of FIG. 14 depicts one side of the module 84 with leg 12 in the stowage position parallel to the football tip holder arm 3 and in the phantom line position when in the ground engaging position.

In the embodiment depicted by FIGS. 13-16, the shaft heads 19, 20 are positioned at the intersection of the longer grooves with the shorter angled grooves as shown by FIG. 15. To disengage the legs 12, 13 from the shallow positioning grooves the user slightly rocks the leg end farthest away from the pivot shaft and then pivots the leg to the desired position in the other groove of the pair.

Figure 17:
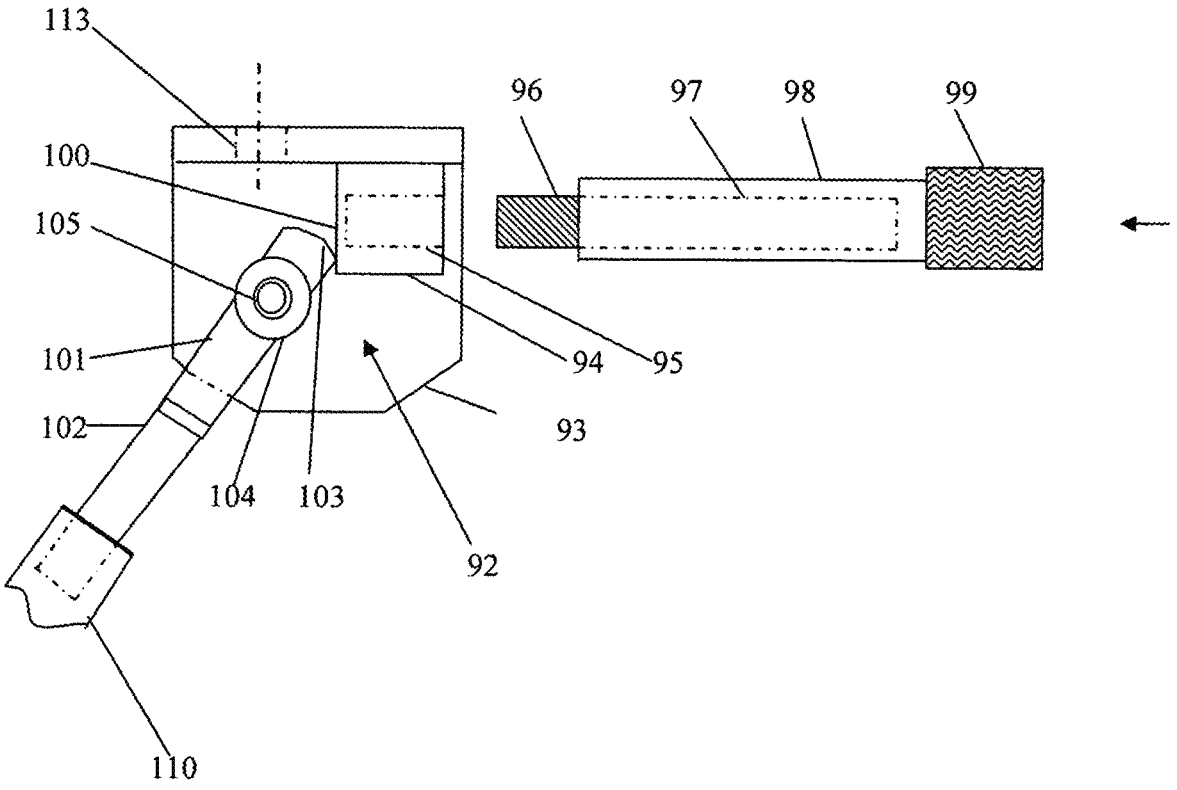
FIG. 17 is another embodiment showing a module 92 laid on one side with only one leg 102 shown connected and the football tip holder arm 98 disconnected.
Figure 18:
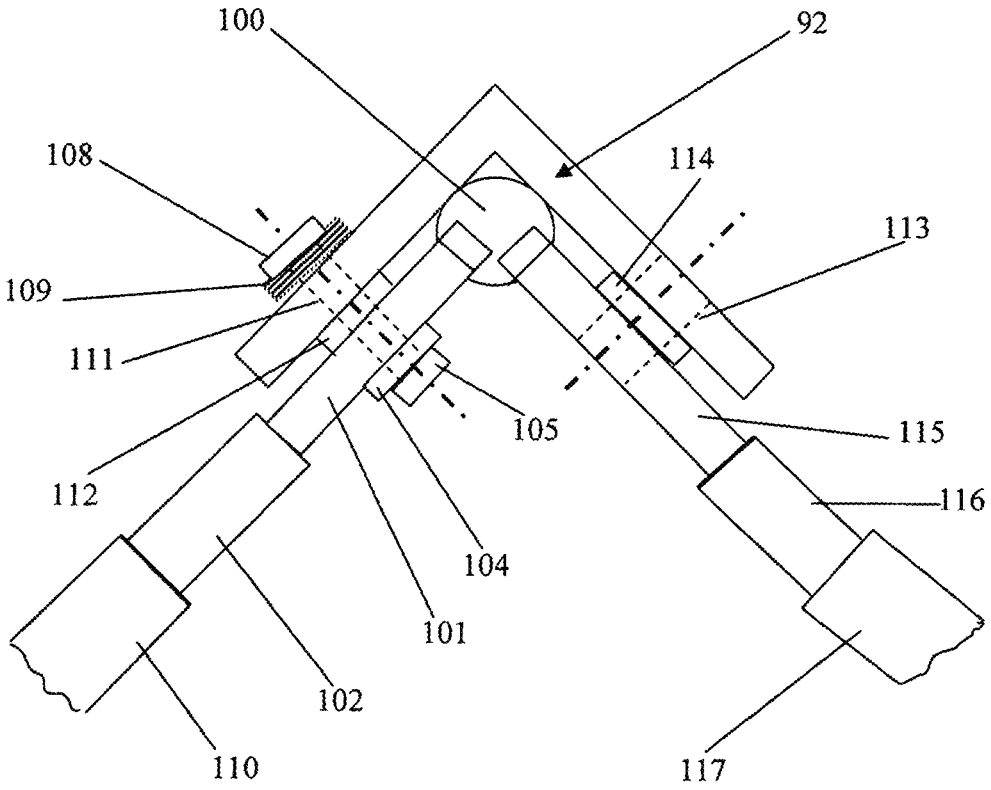
FIG. 18 is the embodiment of FIG. 17 viewed from the rear and showing a portion of both legs behind and contacting the back 100 of tubular retaining nut 94 with only the pivot shaft, compression spring 109 and retaining mechanism for leg 102 shown connected to one underside of module 92 for clarity.

A different preferred embodiment of the compactable football holder is depicted in FIGS. 17-18. This embodiment, as shown in partial end view FIG. 18, provides for an inverted v-shaped module 92 having a pair of ground engaging telescopically extendable legs. Each pair of legs has an end proximal to a respective side forming the inverted v-shaped module 92.

Each proximal end is in the form of flattened tangs 101, 115 which tangs are integral with and joined to a tubular leg 102, 116 having a greater cross section than the cross section of the tangs 101, 115. In the embodiment shown in FIG. 18, outer hollow telescopic tubes 110,117 larger in cross-section than the cross section of tubular legs 102, 116 fit over and telescopically slide toward and away from the inner ends of tubular legs 102, 116. Multiple outer telescopic tubes (not shown) each larger in cross section may be used to extend the pair of legs to the ground. A design choice variation, not shown, may reverse the size of the cross sections of the respective telescopic tubes with the largest cross sectional tubular legs being integral with and joined to the tangs and the smallest cross sectional diameter telescopic tube being in engagement with the ground.

A pivot shaft 111 has a head 108 with the pivot shaft extending through a compression spring 109. The pivot shaft 111 further extends through an open bore hole in the left side of the inverted v-shaped module 92 as viewed in FIG. 18. The shaft 111 further extends through a first washer 112 located between the inner side of the left side of the module 92 and a flat surface of the flattened tang 101. The pivot shaft 111 also extends through a bore hole in the flattened tang 101.

An end cap 105 is swaged to the end of the pivot shaft 111 and to a second washer 104 placed between the end cap and the tang.

This arrangement allows the tubular leg 102 to rotate the pivot shaft relative to the open bore hole. The compression spring 109 is compressed between the head 108 and the side of the inverted v-shaped module by the pressure of the swag. In effect this compression allows the compression spring to act as a brake or clutch providing controlled positioning of the tang 101 of leg 102.

Note that the right hand tang 115 of tubular leg 116 is shown in position spaced by the washer 114 from the open bore hole 113 of the right side of the inverted v-shaped module. For clarity, the pivot shaft, compression spring, washers and retaining swaged end cap have not been illustrated as the telescopically extending legs and connections to the module 92 are symmetrical to each side.

In FIG. 17, the tip 103 of flattened tang 101 is shown touching the back 100 of a closed end retaining nut 94. A similar tip of flattened tang 115 (not shown) also touches the back 100 of the retaining nut 94. The back end of both tips of their respective tangs are shown in FIG. 18. A weld spot 118, shown in FIG. 18, fastens the retaining nut 94 to the inside walls of the inverted v-shaped module 92.

The closed end retaining nut 94 has a female threaded cavity 95 for receiving the male threaded end 96 part of and extending from the football tip folder arm 97. The holder arm 97 may be a hollow tube. An outer hollow telescopic tube 98 having a football tip holding surface 99 is shown in a nested compact form over the hollow tube of the holder arm 97. This threaded connection permits ease of replacement of a damaged holder arm. Like the pair of legs, the cross sectional sizes of the telescoping tubes may be reversed as a matter of design choice with the larger tube cross section being part of the threaded male end.

Although not shown, retaining nut 94 may be open ended to allow the threaded male end 96 to extend axially further under the inverted v-shaped module 92 permitting an adjustment of the angle at which the tips of the flattened tangs engage the male end 96.

The flattened tangs 101, 115 are rectangular in cross section with a narrow side shown in FIG. 18 and a wider side shown in FIG. 17.

The use of the term "tubes" in this disclosure is meant to include the broadest cross-sectional shapes known to be used with telescopic members such as by way of example, circular, triangular, polygonal, rectangular, square, etc.

The compression spring 109 may be a Belleville spring (sometimes called a Belleville washer) or a coil spring. The Belleville spring may be a single spring or a stack of springs. The compression springs may also be positioned on the inner sides of the inverted v-shaped module as shown in the compression springs 90, 91 embodiment of FIG. 14.

While this invention has been described as having preferred design, it is understood that it is capable of further modification, use and/or adaptations following in general the principle of the invention and including such departures from the present disclosure as come within known or customary practice in the art to which the present invention pertains, and as may be applied to the essential features set forth, and fall within the scope of the invention or limits of the appended claims.

What is claimed is:

1. A compactable holder for a football to permit kicking of the football with the football having one end touching the ground comprising:

an inverted v-shaped module formed of a first and second side;

a retaining nut secured beneath the first and second side at a center of the inverted v-shaped module a football tip holder arm which is telescopically extendable and fixedly attached at a proximal end by the retaining nut to prevent rotation with the proximal end extending partially beneath the inverted v-shaped module;

the first side mounting a first pivot shaft and the second side mounting a second pivot shaft;

a pair of legs which are telescopically extendable to the ground to adjust the height of the inverted v-shaped module;

one leg of the pair of legs being connected at a proximal end to the first pivot shaft and the other leg of the pair of legs being connected at a proximal end to the second pivot shaft to permit outward pivoting motion and upward pivoting motion with the outward pivoting motion limited by the proximal ends of the pair of legs being behind and contacting a back of the retaining nut and the upward pivoting motion being upward from the ground to a position beneath the inverted v-shaped module and the football tip holder arm whereby the compactable holder is configured in a compactable stowage form.

2. The compactable holder of claim 1 wherein each leg of the pair of legs comprises at least two different diameter tubes telescopic relative to each other having close tolerance there between to permit adjustable telescopic length.

3. The compactable holder of claim 2 wherein the smallest diameter tube of each pair of legs ends in a flattened tang through which the first and second pivot shafts extend.

4. The compactable holder of claim 2 wherein the largest diameter tube of each pair of legs ends in a flattened tang through which the first and second shafts extend.

5. The compactable holder of claim 1 wherein the football tip holder arm comprises at least two different diameter tubes telescopic relative to each other having close tolerance there between to permit an adjustable telescopic length.

6. The compactable holder of claim 3 wherein the smallest diameter tube of the at least two different diameter tubes is fixedly attached at a proximal end to the inverted v-shaped module.

7. The compactable holder of claim 1 wherein the proximal end of the football tip holder arm is threaded to engage the retaining nut in a fixed manner which threading permits ease of replacement of a damaged football tip holding arm.

8. A compactable holder for a football to permit kicking of the football with the football having one end touching the ground comprising:

a football tip holder arm which is telescopically extendable and retractable;

the football tip holding arm being attached by a retaining nut mounted to a two sided module;

the two sided module mounting first and second pivot shafts having axis extending at right angles to each other;

a pair of legs which are telescopically extendable to the ground to adjust the height of the two sided module;

one leg of the pair of legs being connected at a proximal end to the first pivot shaft and the other leg of the pair of legs being connected at a proximal end to the second pivot shaft to permit outward pivoting motion of the legs to a ground engaging position with the outward pivoting motion limited by the proximal ends of the legs being behind and contacting either a back of the retaining nut or an end of the football tip holder arm extending through the back of the retaining nut with the pair of legs being pivotable from the ground engaging position to a position beneath both the two sided module and the football tip holder arm whereby the compactable holder is configured in a compactable stowage form.

9. The compactable holder of claim 8 wherein one side of the two sided module has an open bore hole through which the first pivot shaft rotates and the other side of the two sided module has an open bore hole through which the second pivot shaft rotates;

each leg of the pair of legs comprises at least two different diameter tubes telescopically extendable relative to each other having close tolerances there between to permit adjustable sliding of the telescopic length by easily hand pulling or pushing an end of the different diameter tubes closest to the ground away from or towards the proximal end of each leg connected to the first or second pivot shaft.

10. The compactable holder of claim 9 wherein the smaller diameter tube of each pair of legs ends in a flattened tang through which the first and second pivot shafts extend.

11. The compactable holder of claim 9 wherein the larger diameter tube of each pair of legs ends in a flattened tang through which the first and second pivot shafts extend.

12. The compactable holder of claim 8 wherein the proximal end of the football tip holder arm is threaded to engage the retaining nut in a fixed manner which threading permits ease of replacement of a damaged football tip holding arm.

13. The compactable holder of claim 8 wherein the first and second pivot shafts have heads larger than the diameter of their shafts and each pivot shaft passes through an open coil compression spring maintained in a compressed form with the open coil compression spring located between the heads of the first and second pivot shafts and outer sides of the two sided module.

14. A compactable holder for a football to permit kicking of the football with the football having one end touching the ground comprising:

an inverted v-shaped module formed of two sides with a first bore hole in one side and a second bore hole in the second side;

a first pivot shaft mounted through the first bore hole for rotation and a second pivot shaft mounted through the second bore hole for rotation;

the first pivot shaft having a head thereon larger than a diameter of the first bore hole and the second pivot shaft having a head larger than a diameter of the second bore hole;

a pair of legs which are telescopically extendable to the ground to adjust the height of the inverted v-shaped module;

one leg of the pair of legs having a bore hole through which the first pivot shaft extends and the other leg of the pair of legs having a bore hole through which the second pivot shaft extends to permit pivoting of each leg to a ground engaging position and to a compactable position beneath the sides of the inverted v-shaped module;

the first pivot shaft being fastened to one end of one leg and the second pivot shaft being fastened to one end of the second leg of the pair of legs whereby rotation of each leg permits pivoting of the legs to a ground engaging position and to a compactable position beneath the inverted v-shaped module;

each of the pair of legs being biased by a compression spring mounted between the shaft heads and the bore holes of the inverted v-shaped module to control the pivoting positions of the legs;

and wherein the inverted v-shaped module rigidly mounts a proximal end of a football tip holder arm which is telescopically extendable to secure the football between a ground engaging position and is telescopically retractable to a compactable position beneath the sides of the inverted v-shaped module.

15. The compactable holder of claim 14 wherein the compression spring is one of a Belleville spring or a coil spring.

16. The compactable holder of claim 14 wherein the first and second pivot shafts rotate in the first and second bore holes of the inverted v-shaped module with pivoting of the legs.

17. The compactable holder of claim 14 wherein the compression spring acts as a braking mechanism to permit controlled movement of the pivoting of the legs.

18. The compactable holder of claim 14 wherein each leg of the pair of legs ends in a flattened tang through which the pivot shafts extend.

19. The compactable holder of claim 18 wherein at least one washer is positioned on each of the pivot shafts in contact between the flattened tang and the inside surface of the sides of the inverted v-shaped module.

20. The compactable holder of claim 19 wherein each pivot shaft has an inner end to which is rigidly attached a washer and end cap having a diameter larger than the bore holes of the flattened tangs through which the pivot shaft extends whereby the compression springs are kept in a compressed state.

* * * * *